US005337478A

United States Patent [19]

Cohen et al.

[11] Patent Number: 5,337,478

[45] Date of Patent: Aug. 16, 1994

[54] AUTOMATIC SHAVING APPARATUS

[76] Inventors: Zaki Cohen, 6110 E. Fifth St., Apt. 115, Tucson, Ariz. 85711; Eli Deckel, 7322 E. Calle Los Arboles, Tucson, Ariz. 85715

[21] Appl. No.: 55,277

[22] Filed: May 3, 1993

[51] Int. Cl.[5] ..... B26B 19/48; B26B 19/30; B26B 21/40

[52] U.S. Cl. ..... 30/41.5; 30/41; 30/90

[58] Field of Search ..... 30/41, 41.5, 43.6, 47, 30/86, 90

[56] References Cited

U.S. PATENT DOCUMENTS

| | | | |
|---|---|---|---|
| 4,380,121 | 4/1983 | Naimer et al. | 30/90 |
| 4,531,287 | 7/1985 | Shibata et al. | 30/90 |
| 5,070,611 | 12/1991 | Derin et al. | 30/41 |
| 5,134,775 | 8/1992 | Althaus et al. | 30/41.5 |

FOREIGN PATENT DOCUMENTS

| | | | |
|---|---|---|---|
| 2382319 | 9/1978 | France | 30/41 |
| 2613975 | 10/1988 | France | 30/41 |
| 2634154 | 1/1990 | France | 30/41 |

*Primary Examiner*—Richard K. Seidel
*Assistant Examiner*—Paul M. Heyrana, Sr.

[57] ABSTRACT

A new and improved automatic shaving apparatus includes a handle assembly which includes a pressurized foam dispensing assembly and an electric valve control assembly. A shaving head assembly is connected to the handle assembly and retains a razor blade assembly. The handle assembly serves as a handle during shaving and also serves as a housing for the pressurized foam dispensing assembly and the electric valve control assembly. The pressurized foam dispensing assembly stores and dispenses shaving foam from the shaving head assembly. The electric valve control assembly controls release of shaving foam from the pressurized foam dispensing assembly. An electric power source powers the electric valve control assembly. A switch assembly is placed in circuit between the electric power source and the electric valve control assembly for controlling electric power to the electric valve control assembly. The shaving head assembly also includes a foam conduit for conveying foam from the pressurized foam dispensing assembly to near by the razor blade assembly for depositing foam on the surface being shaved. The automatic shaving apparatus may also include a pressurized lotion dispensing assembly, housed in the handle assembly, for storing and dispensing lotion to near by the razor blade assembly for depositing lotion on the surface being shaved. The electric valve control assembly controls release of lotion from the pressurized lotion dispensing assembly. The switch assembly may be actuated by placement of the shaving head assembly against the surface being shaved.

2 Claims, 4 Drawing Sheets

AUTOMATIC SHAVING APPARATUS

BACKGROUND OF THE INVENTION

1. Field of the Invention

The present invention relates generally to razors for shaving, and more particularly, to razors especially adapted for dispensing shaving foam during the shaving operation.

2. Description of the Prior Art

Razors that dispense shaving foam during the shaving operation are well known in the art. For example, the following U.S. patents disclose razors with which shaving foam can be manually dispensed from a foam dispenser during the shaving operation: U.S. Pat. Nos. 4,653,188; 5,070,611; 5,072,512; and Des. 310,889.

Manual dispensing of shaving foam has distinct disadvantages. A squeezing motion for manual dispensing may be incompatible with a careful shaving stroke motion for nick free shaving. In this way, manual squeezing for foam dispensing may inadvertently cause undesirable nicking of the skin. In this respect, it would be desirable if a device were provided that dispensed shaving foam without requiring a separate manually controlled release of shaving foam.

Many people use razors that contain no foam dispensing capabilities. With such razors, foam is applied to the hands, and then applied to the face. In the process, much foam is left on the hands and washed off. Such foam is wasted. In this respect, it would be desirable if a device were provided that dispensed foam directly on the face without wasting foam that must be washed off of the hands.

Often, after a shave, a person will apply a lotion that soothes the newly shaved skin. Lotion application takes extra time, after the shaving operation. For a person who is rushed, the extra time may be quite burdensome. Moreover, lotion is dispensed from a bottle onto the hands and then applied to the face. Much lotion is wasted on the hands and is often washed off. Otherwise, the hands, and everything the hands touch, will bear the lotion and its attendant odor. In this respect, it would be desirable if a device were provided that avoided the need to first apply lotion to the hands and then use the hands to apply lotion to the face.

Conventionally, the overall shaving operation, using a safety razor, requires four distinct operations: (a) releasing foam, (b) spreading foam on the surface to be shaved, (c) shaving the surface, and (d) applying lotion to the shaved area. In this respect, it would be desirable if a device were provided that performed all of the above four operations with a single continuous shaving operation.

The shaving operation is inherently fraught with friction. The shaving head, especially the blades, scrape along the whiskers and skin. The foam helps alleviate the friction, but a mechanical device to alleviate friction would also be desirable. In this respect, it would be desirable if a shaving device were provided which included a mechanical structure designed to reduce shaving friction.

When a person travels, one must often bring along a shaving kit that includes the razor, a can of foam, and a container of lotion. To remember to three items to pack is more burdensome that remembering only one item to pack. Furthermore, three items to pack require more space in luggage than only one item to pack. In this respect, it would be desirable if a single shaving device were provided that avoided the necessity of remembering and packing three separate shaving items.

Thus, while the foregoing body of prior art indicates it to be well known to use razors that have an associated manually operated foam dispenser, the prior art described above does not teach or suggest an automatic shaving apparatus which has the following combination of desirable features: (1) dispenses shaving foam without requiring a separate manually controlled release of shaving foam; (2) avoids the need to first apply lotion to the hands and then use the hands to apply lotion to the face; (3) dispenses foam directly on the face without wasting foam that must be washed off of the hands; (4) performs the four shaving operations of (a) releasing foam, (b) spreading foam on the surface to be shaved, (c) shaving the surface, and (d) applying lotion to the shaved area with a single continuous shaving operation; (5) includes a mechanical structure designed to reduce shaving friction; (6) avoids the necessity of remembering and packing three separate shaving items. The foregoing desired characteristics are provided by the unique automatic shaving apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved automatic shaving apparatus which includes a handle assembly which includes a pressurized foam dispensing assembly and an electric valve control assembly. A shaving head assembly is connected to the handle assembly and retains a razor blade assembly. The handle assembly serves as a handle during shaving and also serves as a housing for the pressurized foam dispensing assembly and the electric valve control assembly. The pressurized foam dispensing assembly stores and dispenses shaving foam from the shaving head assembly. The electric valve control assembly controls release of shaving foam from the pressurized foam dispensing assembly. An electric power source powers the electric valve control assembly. A switch assembly is placed in circuit between the electric power source and the electric valve control assembly for controlling electric power to the electric valve control assembly. The shaving head assembly also includes a foam conduit for conveying foam from the pressurized foam dispensing assembly to near by the razor blade assembly for depositing foam on the surface being shaved. The automatic shaving apparatus may also include a pressurized lotion dispensing assembly, housed in the handle assembly, for storing and dispensing lotion to near by the razor blade assembly for depositing lotion on the surface being shaved. The electric valve control assembly controls release of lotion from the pressurized lotion dispensing assembly. The switch assembly may be actuated by placement of the shaving head assembly against the surface being shaved.

A foam-spreading plate is present for smoothing foam dispensed from the foam conduit into a even layer on the surface being shaved. The shaving head assembly includes a plurality of lotion-dispensing apertures for applying lotion to the surface being shaved. The shaving head assembly further includes a roller assembly for permitting the shaving head assembly to roll upon the surface being shaved.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved automatic shaving apparatus which has all of the advantages of the prior art and none of the disadvantages.

It is another object of the present invention to provide a new and improved automatic shaving apparatus which may be easily and efficiently manufactured and marketed.

It is a further object of the present invention to provide a new and improved automatic shaving apparatus which is of durable and reliable construction.

An even further object of the present invention is to provide a new and improved automatic shaving apparatus which is susceptible of a low cost of manufacture with regard to both materials and labor, and which accordingly is then susceptible of low prices of sale to the consuming public, thereby making such automatic shaving apparatus available to the buying public.

Still yet a further object of the present invention is to provide a new and improved automatic shaving apparatus that dispenses shaving foam without requiring a separate manually controlled release of shaving foam.

Still another object of the present invention is to provide a new and improved automatic shaving apparatus that avoids the need to first apply lotion to the hands and then use the hands to apply lotion to the face.

Yet another object of the present invention is to provide a new and improved automatic shaving apparatus that dispenses foam directly on the face without wasting foam that must be washed off of the hands.

Even another object of the present invention is to provide a new and improved automatic shaving apparatus that performs the four shaving operations of (a) releasing foam, (b) spreading foam on the surface to be shaved, (c) shaving the surface, and (d) applying lotion to the shaved area with a single continuous shaving operation.

Still a further object of the present invention is to provide a new and improved automatic shaving apparatus which includes a mechanical structure designed to reduce shaving friction.

Yet another object of the present invention is to provide a new and improved automatic shaving apparatus that provides a single shaving device that avoids the necessity of remembering and packing three separate shaving items.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
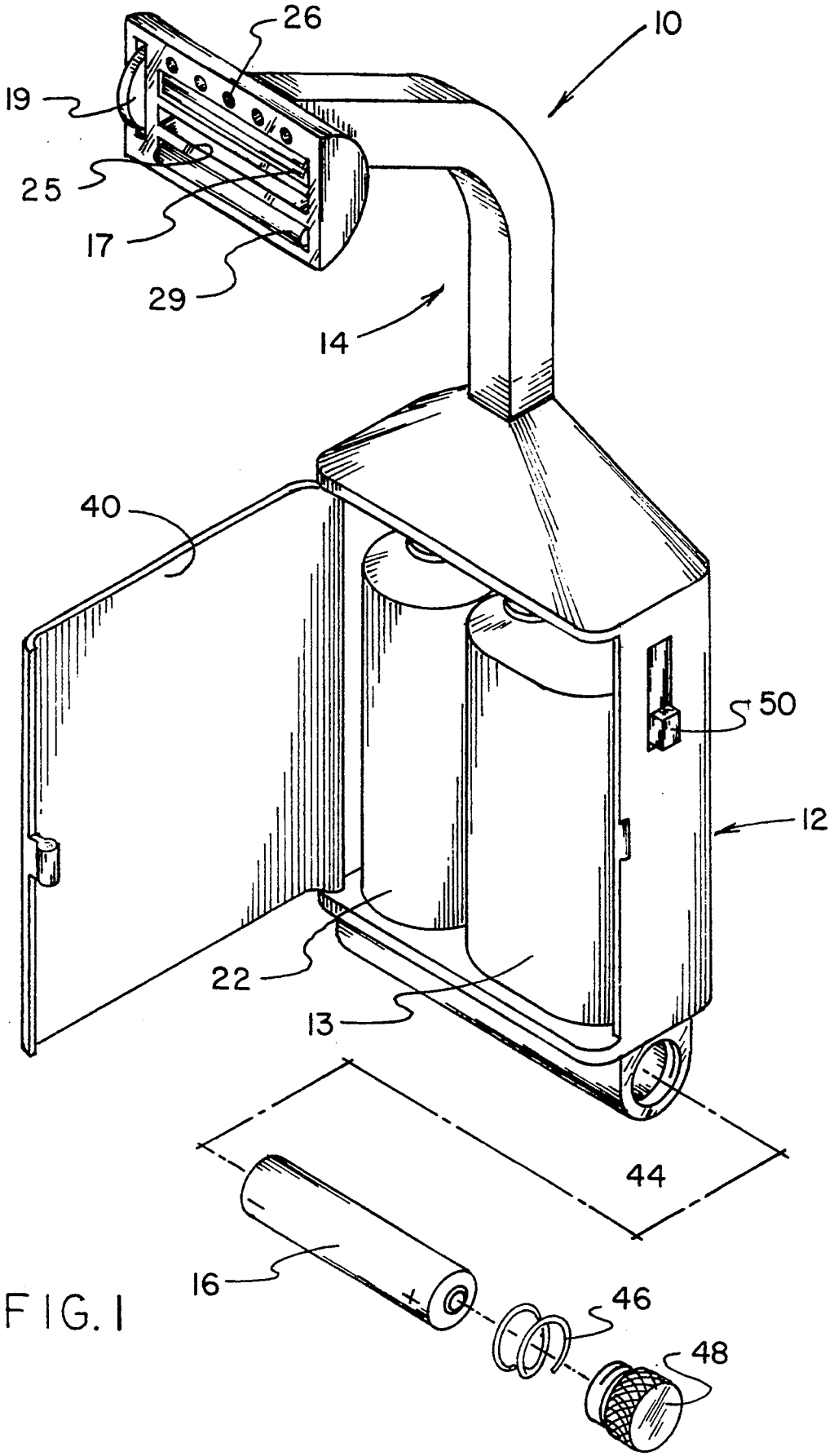
FIG. 1 is a partially exploded perspective view showing a preferred embodiment of the automatic shaving apparatus of the invention.
Figure 2:
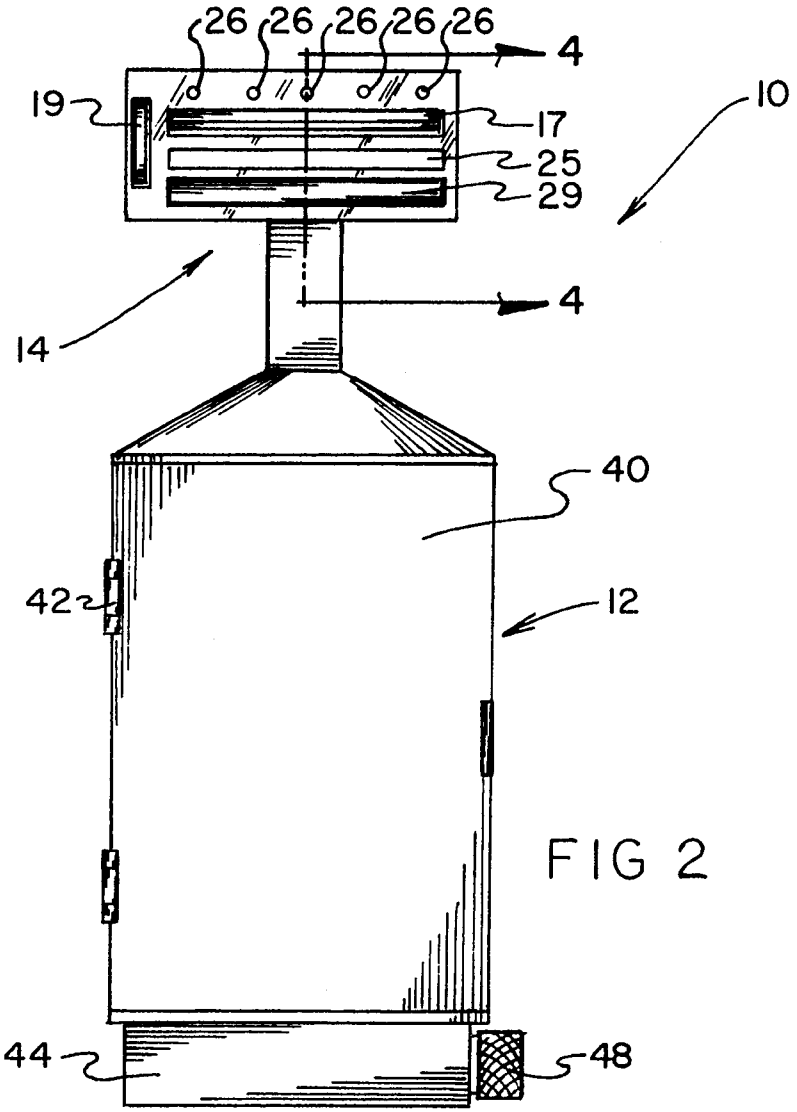
FIG. 2 is a front view of the embodiment of the automatic shaving apparatus shown in FIG. 1.
Figure 3:
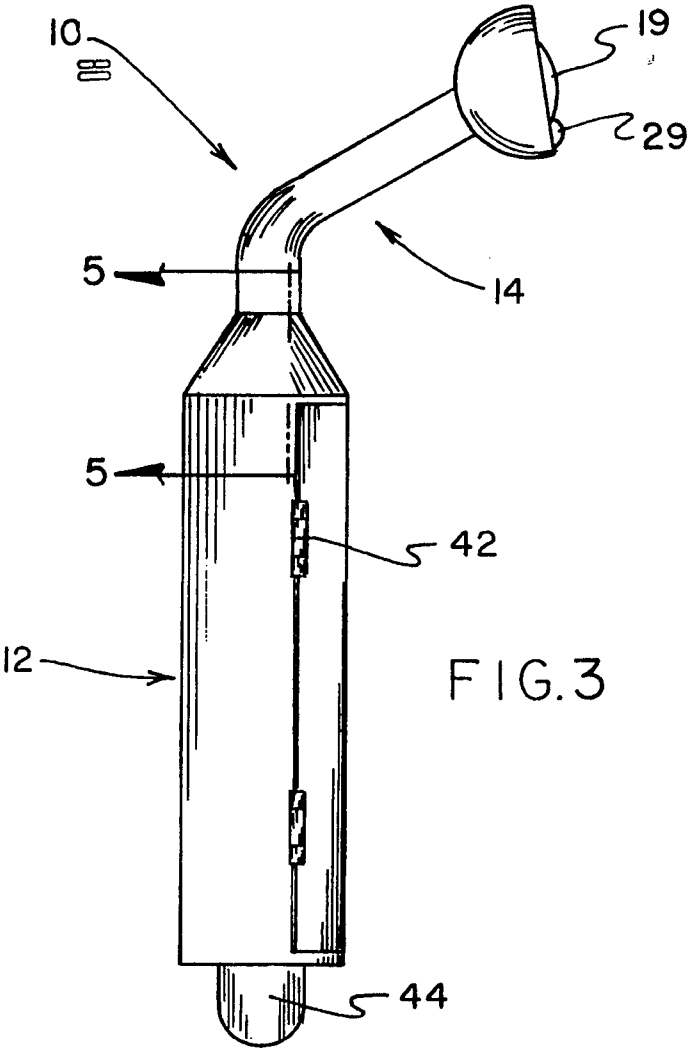
FIG. 3 is a side view of the embodiment of the automatic shaving apparatus shown in FIG. 1.
Figure 4:
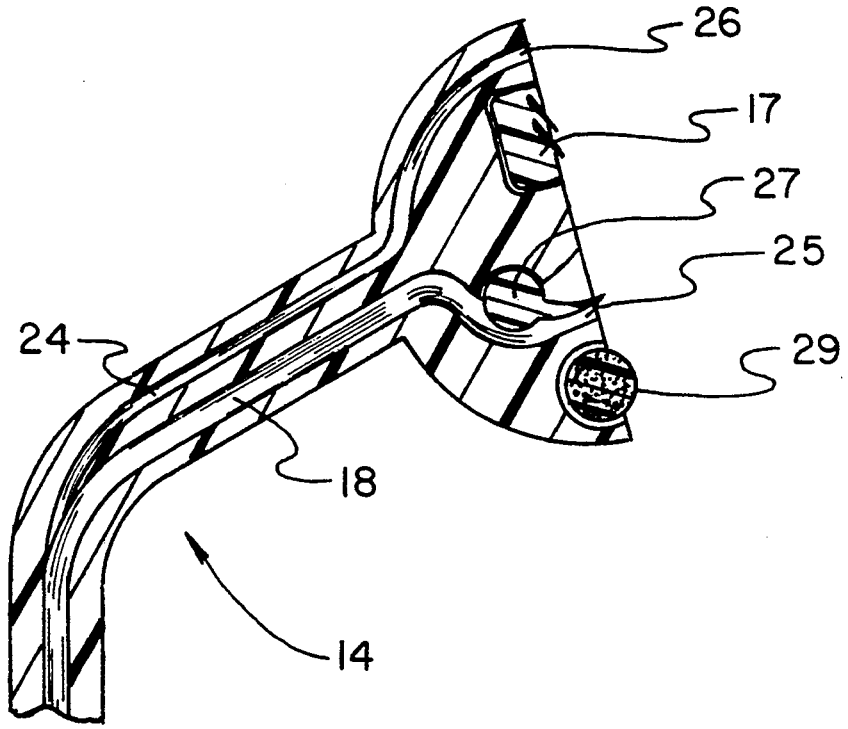
FIG. 4 is an enlarged cross-sectional view of the head portion of the embodiment of the automatic shaving apparatus shown in FIG. 2 taken along line 4—4 thereof.
Figure 5:
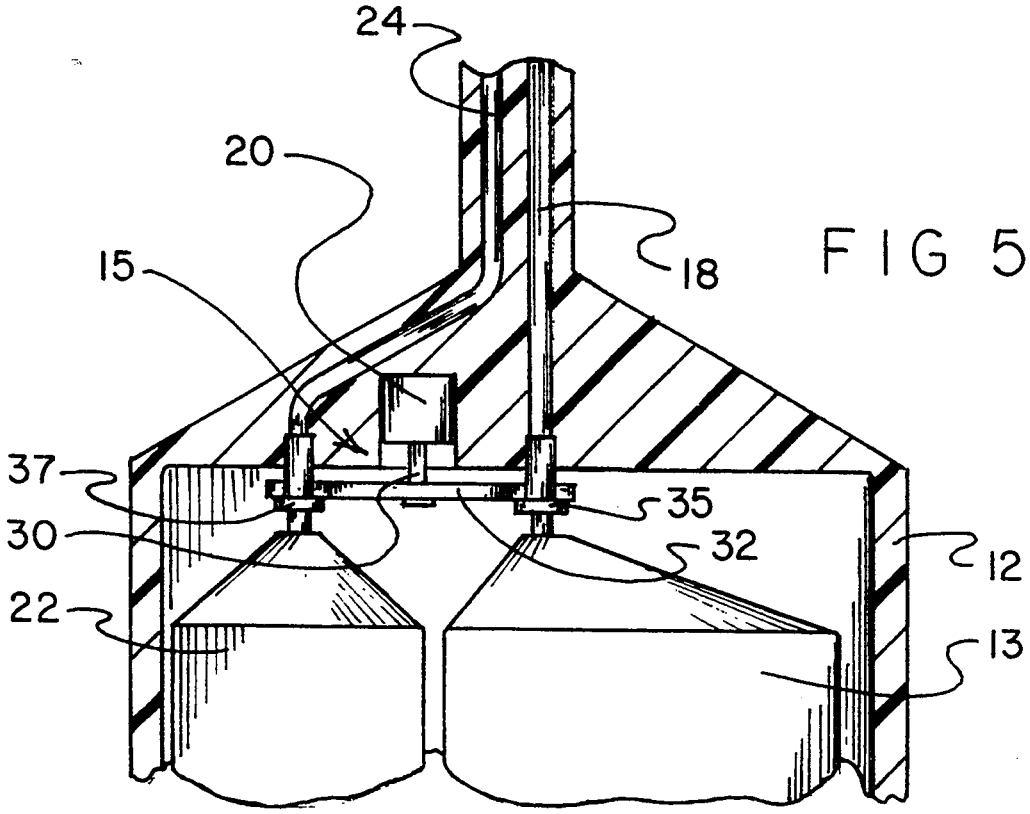
FIG. 5 is an enlarged cross-sectional view of a portion of the head portion and a portion of the handle assembly portion of the embodiment shown in FIG. 3 taken along the line 5—5 thereof.

With reference to the drawings, a new and improved automatic shaving apparatus embodying the principles and concepts of the present invention will be described.

Turning initially to FIGS. 1-6, there is shown an embodiment of the automatic shaving apparatus of the invention generally designated by reference numeral 10. In its preferred form, automatic shaving apparatus 10 includes a handle assembly 12 which includes pressurized foam dispensing assembly 13 and electric valve control assembly 15. The handle assembly 12 serves as a handle during shaving and serves to house the pressurized foam dispensing assembly 13 and the electric valve control assembly 15. The pressurized foam dispensing assembly 13 stores and dispenses shaving foam. The handle assembly 12 includes a door 40 having hinges 42.

The electric valve control assembly 15 controls release of shaving foam from the pressurized foam dispensing assembly 13. The electric power source 16 (shown as a battery 16) powers the electric valve control assembly 15. The battery 16 is retained in a battery housing 44 by a spring 46 and a screw cap 48. An on/off switch 50 is also provided in the electric circuit (see FIG. 7). The electric valve control assembly 15 include an electrically powered solenoid assembly 20. The electrically powered solenoid assembly 20 includes a plunger 30 which is connected to an actuation bar 32. The actuation bar 32 includes a first slot 34 for engaging the outside surface of a valve 35 for the pressurized foam dispensing assembly 13.

A switch assembly 19 is placed in circuit (see FIG. 7) between the electric power source 16 and the electric valve control assembly 15. The switch assembly 19 controls electric power to the electric valve control assembly 15. The switch assembly 19 shown in the drawing figures is actuated by placement of the shaving head assembly 14 against the surface being shaved.

A shaving head assembly 14 is connected to the handle assembly 12 and retains a razor blade assembly 17. The shaving head assembly 14 includes foam conduit 18 for conveying foam from the pressurized foam dispensing assembly 13 to near by the razor blade assembly 17 for deposition of foam on a surface being shaved.

A pressurized lotion dispensing assembly 22 is housed in the handle assembly 12 for storing and dispensing lotion. A lotion conduit 24 is housed in the shaving head assembly 14 and connects to the pressurized lotion dispensing assembly 22. The lotion conduit means 24 conveys lotion from the pressurized lotion dispensing assembly 22 to near by the razor blade assembly 17 for deposition of lotion on the surface being shaved. The electric valve control assembly 15 also controls release of lotion from the pressurized lotion dispensing assembly 22. The actuation bar 32 includes a second slot 36 for engaging the outside surface of a valve 37 for the pressurized lotion dispensing assembly 22.

The shaving head assembly 14 includes a dispensing slot 25 for releasing foam from the foam conduit 18 to the surface being shaved. In addition, the shaving head assembly 14 includes a foam-spreading plate 27 for smoothing foam dispensed from the foam conduit 18 into a even layer on the surface being shaved.

The shaving head assembly 14 also includes a plurality of lotion-dispensing apertures 26 for releasing lotion from the lotion conduit 24 to the surface being shaved.

The shaving head assembly 14 further includes roller assembly 29 for permitting the shaving head assembly 14 to roll upon the surface being shaved.

Figure 7:
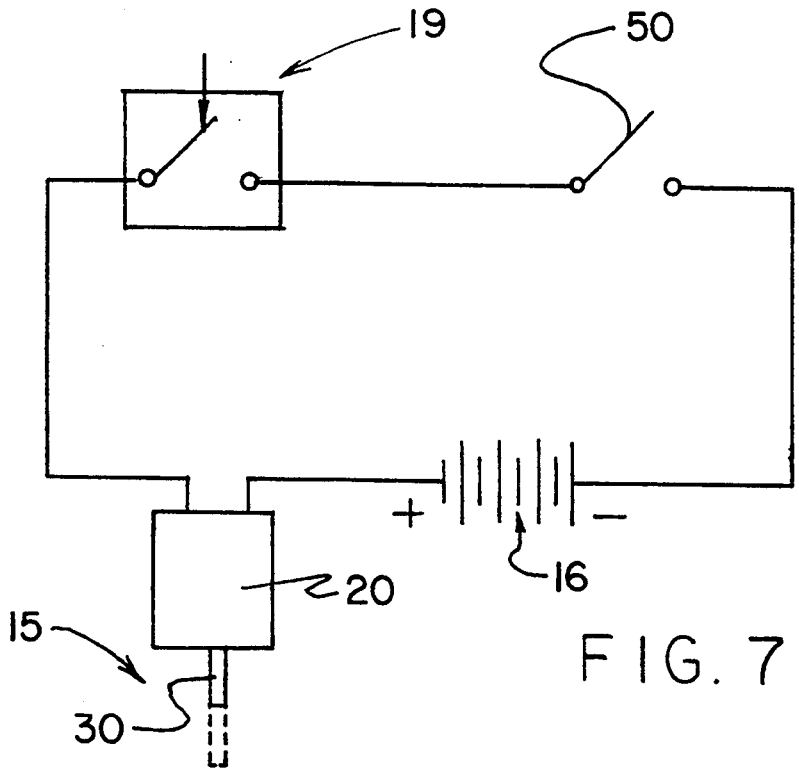
FIG. 7 is a schematic electrical diagram of electrical circuitry used to power the electric valve control assembly.
Figure 6:
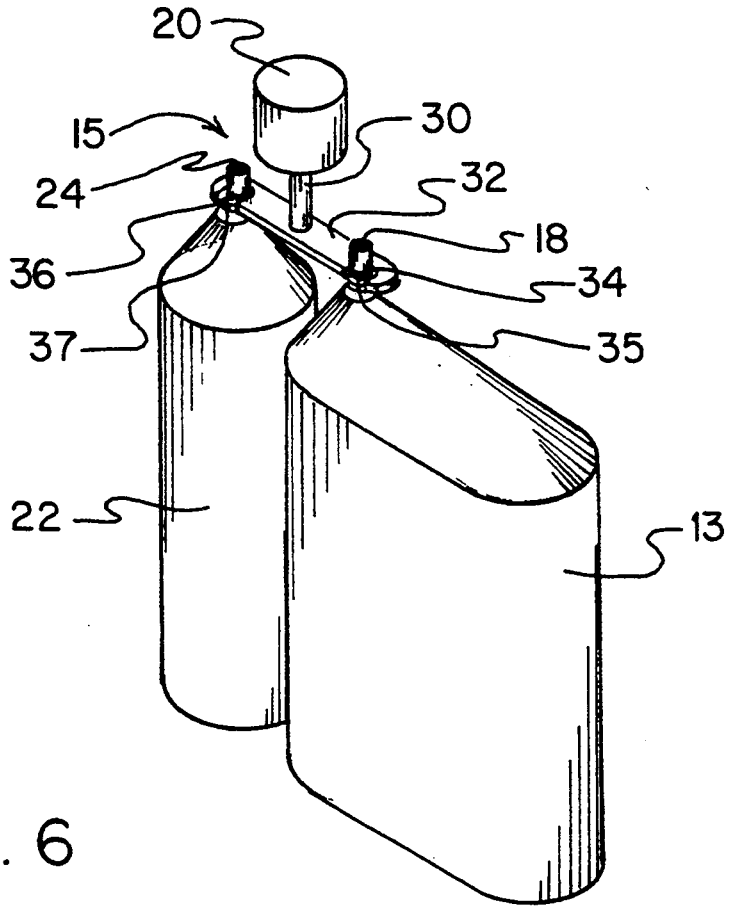
FIG. 6 is a perspective view of the electric valve control assembly, the pressurized foam dispensing assembly, and the pressurized lotion dispensing assembly removed from the handle assembly of the embodiment shown in FIG. 1.

As shown in FIG. 7, the battery 16 is connected to on/off switch 50 which is connected to switch assembly 19 which is connected to electrically powered solenoid assembly 20 which is connected to the battery 16. When the on/off switch 50 is in the closed or "on" position, the status of the electrically powered solenoid assembly 20 depends upon the status of the switch assembly 19. The switch assembly 19 is in open position when the shaving head assembly 14 is away from the surface to be shaved. However, when the shaving head assembly 14 is in contact with the surface to be shaved, the switch assembly 19 is moved to the closed position, and the electrically powered solenoid assembly 20 is actuated. When the electrically powered solenoid assembly 20 is actuated, the plunger 30 is pushed into the lowered position, the actuator bar 32 (see FIG. 6) is lowered, and the valves 35 and 37 are actuated causing release of foam and lotion from the pressurized foam dispensing assembly 13 and the pressurized lotion dispensing assembly 22, respectively.

The automatic shaving apparatus of the invention is a lightweight apparatus and can be sold as a compact shaving kit. It is well suited for indoor and outdoor activities, and is excellent for travelling.

In the embodiment of the automatic shaving apparatus described above, the switch assembly 19 is disclosed as being automatically actuated when the shaving head assembly 14 is contacted with the surface to be shaved. However, the switch assembly 19 may also be manually actuated.

In the embodiment described above, the pressurized lotion dispensing assembly 22 is present. However, if desired, the lotion dispensing assembly 22 can be removed, and a larger pressurized foam dispensing assembly 13 can be employed.

Most of the components of the automatic shaving apparatus of the invention can be made from inexpensive and durable metal or plastic materials.

It is apparent from the above that the present invention accomplishes all of the objects set forth by providing a new and improved automatic shaving apparatus that is low in cost, relatively simple in design and operation, and which may advantageously be used to dispense shaving foam without requiring a separate manually controlled release of shaving foam. With the invention, the need to first apply lotion to the hands and then use the hands to apply lotion to the face is avoided. With the invention, foam is dispensed directly on the face without wasting foam that must be washed off of the hands. With the invention, the four shaving operations of (a) releasing foam, (b) spreading foam on the surface to be shaved, (c) shaving the surface, and (d) applying lotion to the shaved area are performed with a single continuous shaving operation. With the invention, a shaving device is provided which includes a mechanical structure designed to reduce shaving friction. With the invention, a single shaving device is provided that avoids the necessity of remembering and packing three separate shaving items when travelling.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved automatic shaving apparatus, comprising:

handle assembly means which includes pressurized foam dispensing assembly means, pressurized lotion dispensing assembly means, and electric valve control assembly means, said handle assembly means for serving as a handle during shaving and for housing said pressurized foam dispensing assembly means, said pressurized lotion dispensing assembly means, and said electric valve control assembly means, said pressurized foam dispensing assembly means for storing and dispensing shaving foam, said pressurized lotion dispensing assembly means for storing and dispensing lotion, and said electric valve control assembly means for controlling release of shaving foam from said pressurized foam dispensing assembly means and release of lotion from said pressurized lotion dispensing assembly, wherein said electric valve control assembly means include an electrically powered solenoid assembly, electric power source means for powering said electric valve control assembly means, switch assembly means, placed in circuit between said electric power source means and said electric valve control assembly means, for controlling electric power to said electric valve control assembly means, wherein said switch assembly means is actuated by placement of said shaving head assembly means against the surface being shaved, and shaving head assembly means, connected to said handle assembly means, for retaining a razor blade assembly, said shaving head assembly means including foam conduit means for conveying foam from said pressurized foam dispensing assembly means to near by said razor blade assembly for deposition of foam on a surface being shaved, said shaving head assembly means including lotion conduit means for conveying lotion from said pressurized lotion dispensing assembly means to near by said razor blade assembly for deposition of lotion on the surface being shaved, said shaving head assembly means including a dispensing slot for releasing foam from said foam conduit means to the surface being shaved, said shaving head assembly means include a plurality of lotion-dispensing apertures for releasing lotion from said lotion conduit means to the surface being shaved, and said shaving head assembly means including a foam-spreading plate for smoothing foam dispensed from said foam conduit means into a even layer on the surface being shaved.

2. The apparatus described in claim 1 wherein said shaving head assembly means further include roller assembly means for permitting said shaving head assembly means to roll upon the surface being shaved.

* * * * *